US008479692B2

(12) United States Patent
Ishimitsu

(10) Patent No.: US 8,479,692 B2
(45) Date of Patent: Jul. 9, 2013

(54) VALVE COOLING DEVICE OF INTERNAL COMBUSTION ENGINE

(75) Inventor: Kengo Ishimitsu, Wako (JP)

(73) Assignee: Honda Motor Co., Ltd, Tokyo (JP)

( * ) Notice: Subject to any disclaimer, the term of this patent is extended or adjusted under 35 U.S.C. 154(b) by 0 days.

(21) Appl. No.: 13/542,779

(22) Filed: Jul. 6, 2012

(65) Prior Publication Data

US 2013/0014712 A1 Jan. 17, 2013

(30) Foreign Application Priority Data

Jul. 13, 2011 (JP) ..... P2011-154808

(51) Int. Cl.
*F01P 1/08* (2006.01)

(52) U.S. Cl.
USPC ..... 123/41.41; 123/188.9; 29/888.4

(58) Field of Classification Search
USPC ..... 123/41.41, 41.34, 188.9, 188.2; 29/888.4, 29/888.45; 251/368; 137/340
See application file for complete search history.

(56) References Cited

U.S. PATENT DOCUMENTS

| | | | | | |
|---|---|---|---|---|---|
| 1,186,860 | A | * | 6/1916 | Sturtvant | 123/41.41 |
| 3,871,339 | A | * | 3/1975 | Kuhn | 123/41.41 |
| 3,911,875 | A | * | 10/1975 | Ysberg | 123/41.34 |
| 3,945,356 | A | * | 3/1976 | Kuhn | 123/41.41 |
| 4,164,957 | A | * | 8/1979 | Goloff | 137/340 |
| 4,169,488 | A | * | 10/1979 | Goloff et al. | 137/340 |
| 4,187,807 | A | * | 2/1980 | Cemenska et al. | 123/41.34 |
| 7,603,976 | B2 | * | 10/2009 | Abele | 123/188.3 |

FOREIGN PATENT DOCUMENTS

| | | |
|---|---|---|
| JP | 05-202747 A | 8/1993 |
| JP | 2006-266130 A | 10/2006 |

* cited by examiner

*Primary Examiner* — Noah Kamen
*Assistant Examiner* — Hung Q Nguyen
(74) *Attorney, Agent, or Firm* — Squire Sanders (US) LLP

(57) ABSTRACT

A valve cooling device of an internal combustion engine in which engine oil is circulated in a valve that faces a combustion chamber, the valve includes a valve umbrella portion and a valve stem. An inside of the valve stem is formed with an oil introduction channel and an oil lead-out channel, a jet portion that includes a jet oil passage coaxially disposed with the oil introduction channel is provided in the extended direction of the valve stem, and the engine oil is injected from an orifice provided on a tip portion of the jet oil passage to an inner portion of the oil introduction channel.

12 Claims, 7 Drawing Sheets

VALVE COOLING DEVICE OF INTERNAL COMBUSTION ENGINE

BACKGROUND OF THE INVENTION

The present invention relates to a valve cooling device that circulates engine oil in valves of an internal combustion engine.

Priority is claimed on Japanese Patent Application No. 2011-154808, filed Jul. 13, 2011, the content of which is incorporated herein by reference.

BACKGROUND ART

In the related art, a valve cooling device is known which circulates engine oil in the inner portion of a valve through a flow channel in a valve stem.

For example, in Japanese Unexamined Patent Application, First Publication No. 2006-266130, an oil supply and discharge port is provided on a side surface of a valve lifter with respect to the inner portion of a valve, and the oil supply and discharge port is opened to either an oil jacket in a head or a space in the head according to an operation of the valve lifter.

Moreover, in Japanese Unexamined Patent Application, First Publication No. H5-202747, engine oil is supplied from a plunger portion that configures a pivot of a locker arm to an oil jacket in a valve umbrella portion via (a) an oil collector in a base end portion of the locker arm, (b) an oil passage in an arm main body of the locker arm, (c) an oil discharge channel in a tip portion (spherical-convex portion) of the locker arm, and (d) an introduction channel in the valve stem. Moreover, the supplied engine oil is returned to a space in the head via a lead-out channel in the valve stem.

However, in the technology described in Japanese Unexamined Patent Application, First Publication No. 2006-266130, since an engine oil discharge pathway is intermittently opened and the engine oil in the valve is discharged due to inertia of the reciprocation of the valve, circulation of the engine oil is incomplete, and there is a problem in that it is difficult to perform valve cooling.

In addition, in the technology described in Japanese Unexamined Patent Application, First Publication No. H5-202747, heat exchange between the engine oil having relatively high temperature after cooling the valve umbrella portion and the engine oil having relatively low temperature just after being introduced to the valve is generated through a partition between the introduction channel and the lead-out channel in the valve stem, there is also a problem in that it is difficult to perform valve cooling.

Therefore, an object of the present invention is to provide improved circulation of engine oil in a valve, to suppress heat exchange of the engine oil before and after cooling the valve, and to provide a valve cooling having improved efficiency in a device of an internal combustion engine.

SUMMARY OF THE INVENTION (1) According to an aspect of the present invention, a valve cooling device of an internal combustion engine is provided in which engine oil is circulated in a valve that faces a combustion chamber, wherein the valve includes: a valve umbrella portion that intakes air from the combustion chamber side or opens and closes an exhaust passage end; and a valve stem that extends from the valve umbrella portion to a valve operating chamber side, wherein the valve stem includes: an oil introduction channel which extends so as to be parallel to the valve stem and in which one end is opened in an extended direction of the stem and the other end reaches an inner portion of the valve umbrella portion; and an oil lead-out channel which similarly extends so as to be parallel to the valve stem and in which one end communicates with the other end of the oil introduction channel in the valve umbrella portion and the other end is opened to an inner portion of the valve operating chamber, a jet portion that includes a jet oil passage coaxially disposed with the oil introduction channel is provided in the extended direction of the valve stem, and the engine oil is injected from an orifice provided on a tip portion of the jet oil passage to an inner portion of the oil introduction channel.

(2) In the valve cooling device of an internal combustion engine described in (1), the valve stem may include a hollow stem main body that forms the outer circumferential shape and an inner pipe that is coaxially inserted into the hollow stem main body, and the oil introduction channel may be formed on an inner circumference of the inner pipe, and the cylindrical oil lead-out channel may be formed on an outer circumference of the inner pipe and an outer circumference of the hollow stem main body.

(3) In the valve cooling device of an internal combustion engine described in (2), a sum of concentricity between the inner pipe and the orifice and a diameter of the orifice may be smaller than a diameter of an oil introduction port of the oil introduction channel.

(4) In the valve cooling device of an internal combustion engine described in (3), a diffusion angle θj of an oil jet stream that is injected from the orifice may be expressed by Equation A below when an inner diameter of the inner pipe is dpi, the diameter of the orifice is dj, a distance from the orifice to an inner bottom surface of the valve umbrella portion is H, and a valve maximum lift amount is L.

$$\theta j=\tan^{-1}\{(dpi-dj)/2(H+L)\} \quad \text{[Equation A]}$$

(5) In the valve cooling device of an internal combustion engine described in (2), the diffusion angle θj of an oil jet stream that is injected from the orifice may be expressed by Equation A below when the inner diameter of the inner pipe is dpi, the diameter of the orifice is dj, the distance from the orifice to the inner bottom surface of the valve umbrella portion is H, and the valve maximum lift amount is L.

$$\theta j=\tan^{-1}\{(dpi-dj)/2(H+L)\} \quad \text{[Equation A]}$$

(6) In the valve cooling device of an internal combustion engine described in any one of (1) to (5), a flow channel area of the oil lead-out channel may be larger than the flow channel area of the oil introduction channel.

(7) In the valve cooling device of an internal combustion engine described in any one of (1) to (6), an oil jacket that has an outer diameter larger than the outer diameter of the stem when viewed from an axial direction of the valve stem may be formed in the valve umbrella portion.

(8) In the valve cooling device of an internal combustion engine described in any one of (1) to (7), a gallery for jet may be provided between an exhaust cam shaft and an intake cam shaft, and the jet portion may be connected to the gallery for jet.

PREFERRED EMBODIMENT

Hereinafter, an embodiment of the present invention will be described with reference to the drawings.

Figure 1:
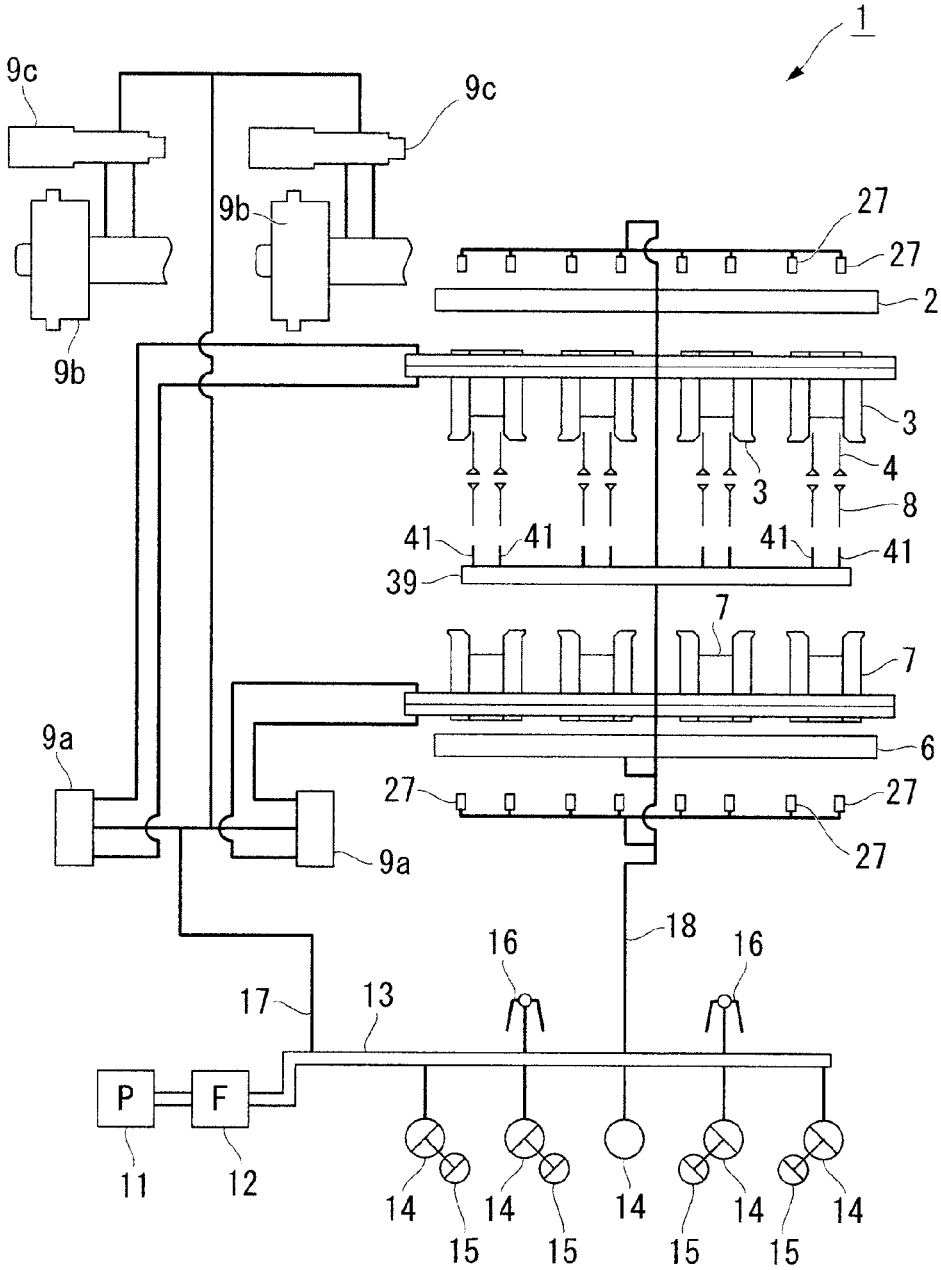
FIG. 1 is a configuration diagram of an engine in an embodiment of the present invention.

FIG. 1 shows a schematic configuration of an engine (internal combustion engine) 1 which is a prime mover of an automobile. For example, the engine 1 of the present embodiment is a DOHC engine having four cylinders, an intake valve 4 that is opened and closed via an intake locker arm 3 by an intake cam shaft 2, and an exhaust valve 8 that is opened and closed via an exhaust locker arm 7 by an exhaust cam shaft 6.

A valve gear mechanism of the engine 1 can perform not only a valve variable control that drives the intake valve 4 and the exhaust valve 8 but also a cam phase variable control that continuously changes the cam phase of each of the valves 4 and 8 by any one of a plurality of kinds of cams (for example, a low speed cam, a high speed cam, and the like) that are provided for each valve.

For example, in the valve variable control, each of the locker arms 3 and 7 is divided into a plurality of pieces so as to be individually engaged with a plurality of kinds of cams, the pieces are connected to or released from each other according to appearance and disappearance of a connection pin that is disposed between each of the pieces, and the cam for driving the valve can be switched.

The operation of each connection pin is performed by switching a supply passage of the engine oil (oil pressure) to a hydraulic fluid chamber through a spool valve 9*a*.

In cam phase variable control, valve timing is advanced or delayed by changing a relative angle of a transmission member with respect to each of cam shafts 2 and 6 through an operation of a vane actuator 9*b* that is provided on end portions of each of the cam shafts 2 and 6. The operation of each vane actuator 9*b* is performed by switching the supply passage of the engine oil (oil pressure) to the hydraulic fluid chamber through a spool valve 9*c*.

Reference numeral 11 indicates an oil pump in an engine case in the drawings.

Reference numeral 12 indicates an oil filter that is disposed at the downstream side of the oil pump 11.

Reference numeral 13 indicates a main gallery that is disposed at the downstream side of the oil filter 12 and extends in a crank axial direction.

Reference numeral 14 indicates crankshaft bearing oil passages that extend from the main gallery 13.

Reference numeral 15 indicates crank pin oil passages that communicate with the crankshaft bearing oil passages 14.

Reference numeral 16 indicates jet oil passages for a piston that extend from the main gallery 13.

Reference numeral 17 indicates a control oil passage that extends from one end portion of the main gallery 13 and reaches each of spool valves 9*a* and 9*c*.

Reference numeral 18 indicates a cylinder side oil passage that extends from a middle portion of the main gallery 13 and reaches a cylinder head 19.

Hereinafter, a cooling structure of the exhaust valve 8 will be described with reference to FIG. 2. Moreover, the cooling structure may be also similarly applied to the intake valve 4 side.

The exhaust valve 8 integrally includes a valve umbrella portion 21 that opens and closes an opening of a combustion chamber R1 side end of an exhaust port 19*a*, and a bar-shaped valve stem 22 that linearly extends so as to penetrate a wall portion of the exhaust port 19*a* from the valve umbrella portion 21 toward a valve operating chamber R2 that is formed at a side (head tip side) opposite to the combustion chamber R1 in the cylinder head 19. Moreover, reference numeral 19*b* indicates a valve guide that is fixed to the cylinder head 19 and holds the valve stem 22 so as to be inserted in such a manner as to allow the strokes of the valve stem.

A disciform spring retainer 24 that sandwiches a valve spring 23 between a tip portion of the valve stem 22 and a seating surface formed on the cylinder head 19 is integrally mounted on the tip portion of the valve stem 22.

A cylindrical valve lifter 25 having relatively small diameter coaxially protrudes from an end surface of the tip side of the stem in the spring retainer 24, and a valve pressing surface 32*a* of the tip portion 32 of the exhaust locker arm 7 abuts the tip surface of the valve lifter 25.

The exhaust locker arm 7 includes a base end portion 31 that forms a concave spherical surface 31*a* which is matched to a spherical pivot 26 supported to the cylinder head 19, a tip portion 32 that forms a convex curved valve pressing surface 32*a* on the valve lifter 25 side, and a cam roller 33 that is supported to a middle portion between each of the end portions 31 and 32.

The base end portion 31 of the exhaust locker arm 7 is fitted to the pivot 26 from the head tip side and is supported so as to be swung.

Figure 3:
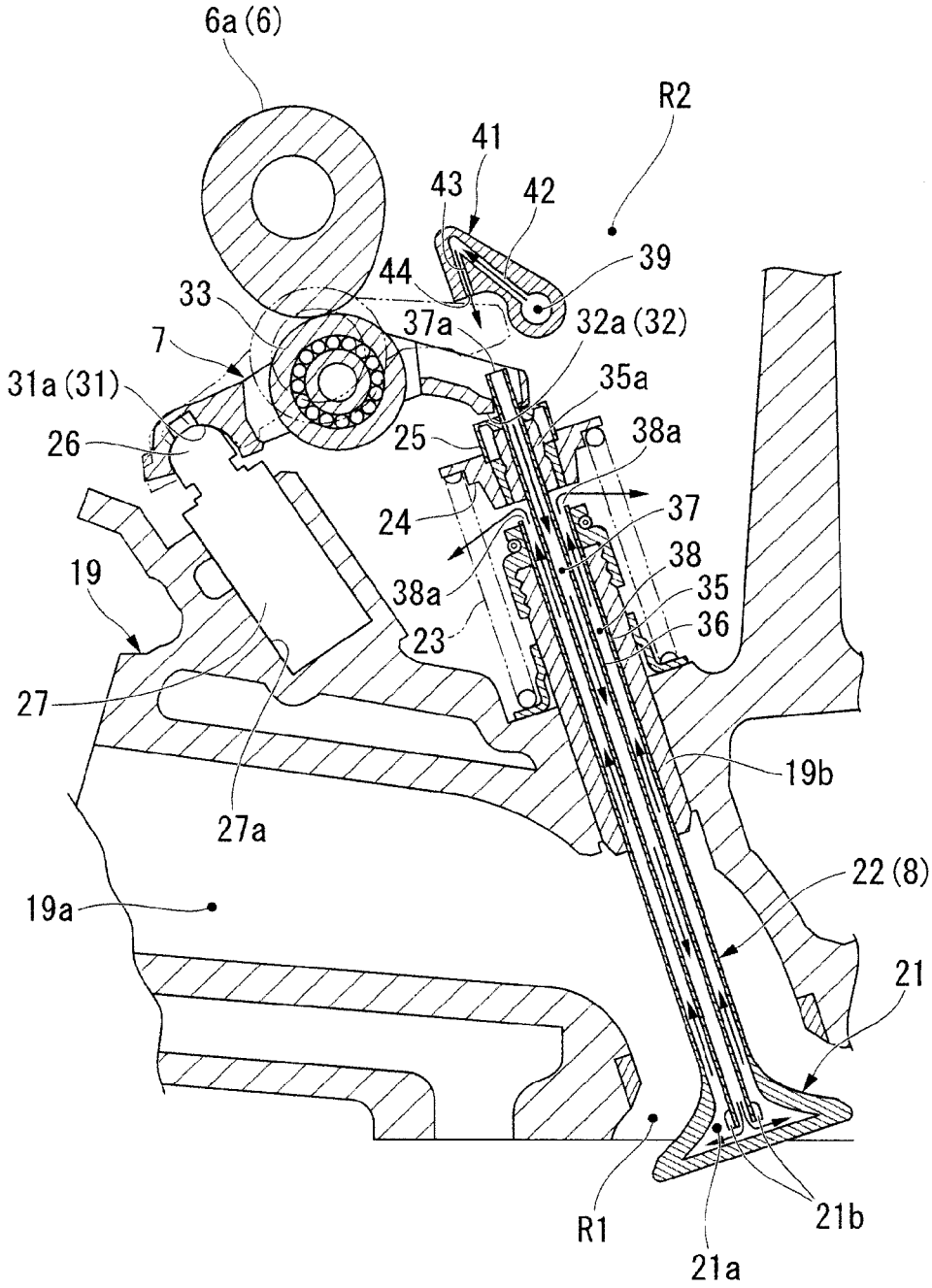
FIG. 3 is a cross-sectional view when closing a valve of the peripheral main portion of the exhaust valve.

The outer circumference of the head tip side of the cam roller 33 is brought into contact with a cam lobe 6*a* of the exhaust cam shaft 6 in a rolling manner, and as shown in FIG. 3, by the rotation of the exhaust cam shaft 6, the cam roller is pressed to the combustion chamber R1 side according to a pattern of the cam lobe 6*a*. At this time, the exhaust locker arm 7 is swung about the pivot 26, and the tip portion 32 presses the exhaust valve 8 via the valve lifter 25 and the spring retainer 24. Thereby, the valve umbrella portion 21 of the exhaust valve 8 is separated from the combustion chamber R1 side opening of the exhaust port 19*a* (exhaust valve 8 is operated so as to be opened).

Figure 2:
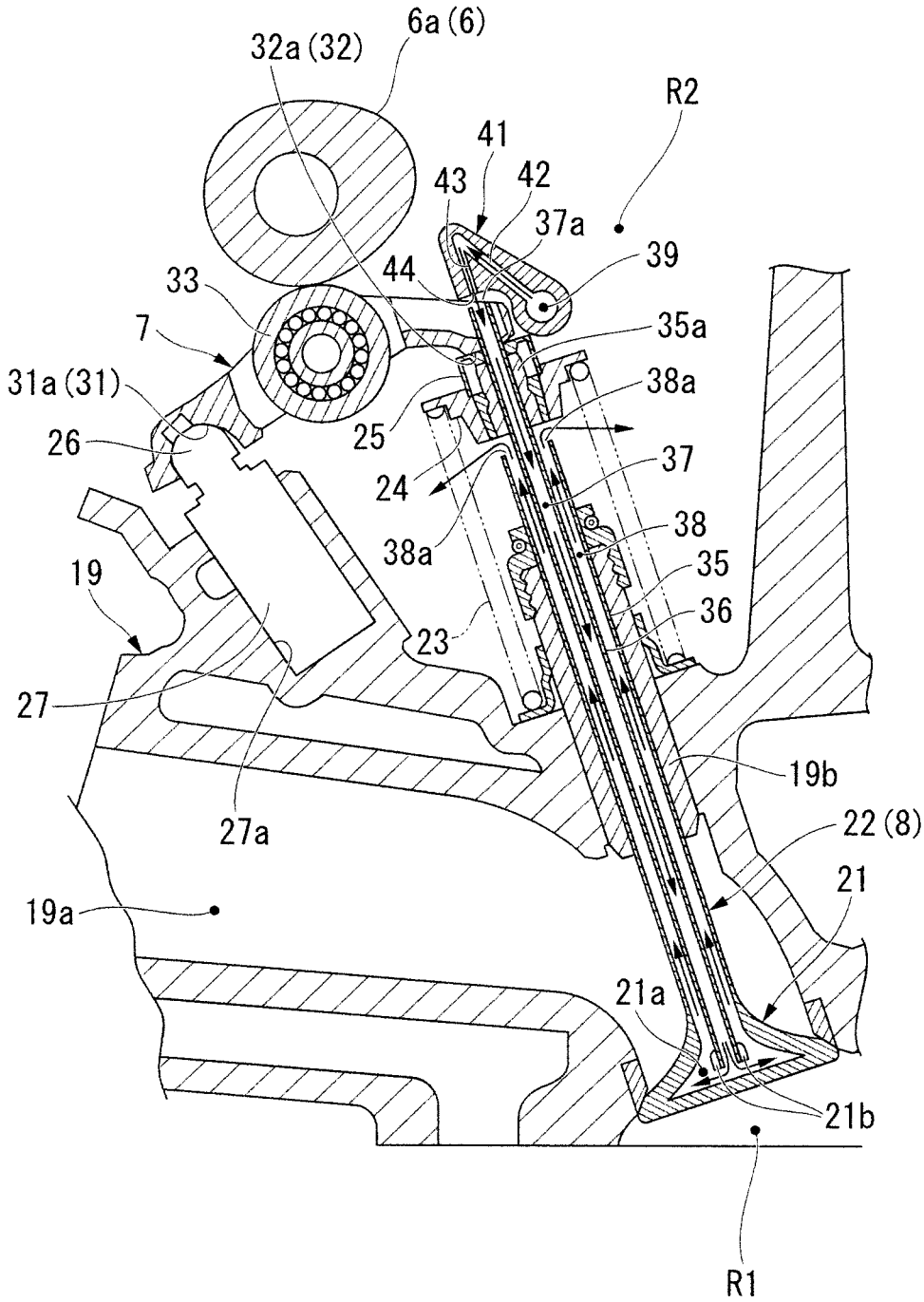
FIG. 2 is a cross-sectional view when closing a valve of the periphery of an exhaust valve of the engine.

In addition, if the exhaust cam shaft 6 is further rotated and the pressing of the cam roller 33 is released, the exhaust valve 8 is operated so as to be closed by the biasing force of the valve spring 23, and according to this, the exhaust locker arm 7 is returned to the state before the swing (refer to FIG. 2).

The pivot 26 is supported by a plunger 27 that is inserted into a holding hole 27*a* of the cylinder head 19 in such a manner as to allow the strokes of the plunger 27. The plunger 27 receives a part of the oil pressure that is supplied to the cylinder head 19 when the engine 1 is operated and pushes up the base end portion 31 of the exhaust locker arm 7 toward the head tip side (exhaust cam shaft 6 side) via the pivot 26. Thereby, a clearance between the valve pressing surface 32*a* and the valve lifter 25 is not present.

As shown in FIG. 2, the valve stem 22 includes a cylindrical hollow stem main body (outer pipe) 35 that forms the outer circumferential shape of the valve stem 22 and the same cylindrical inner pipe 36 that is coaxially inserted into the hollow stem main body 35, and is configured of a double tube structure.

Figure 4A:
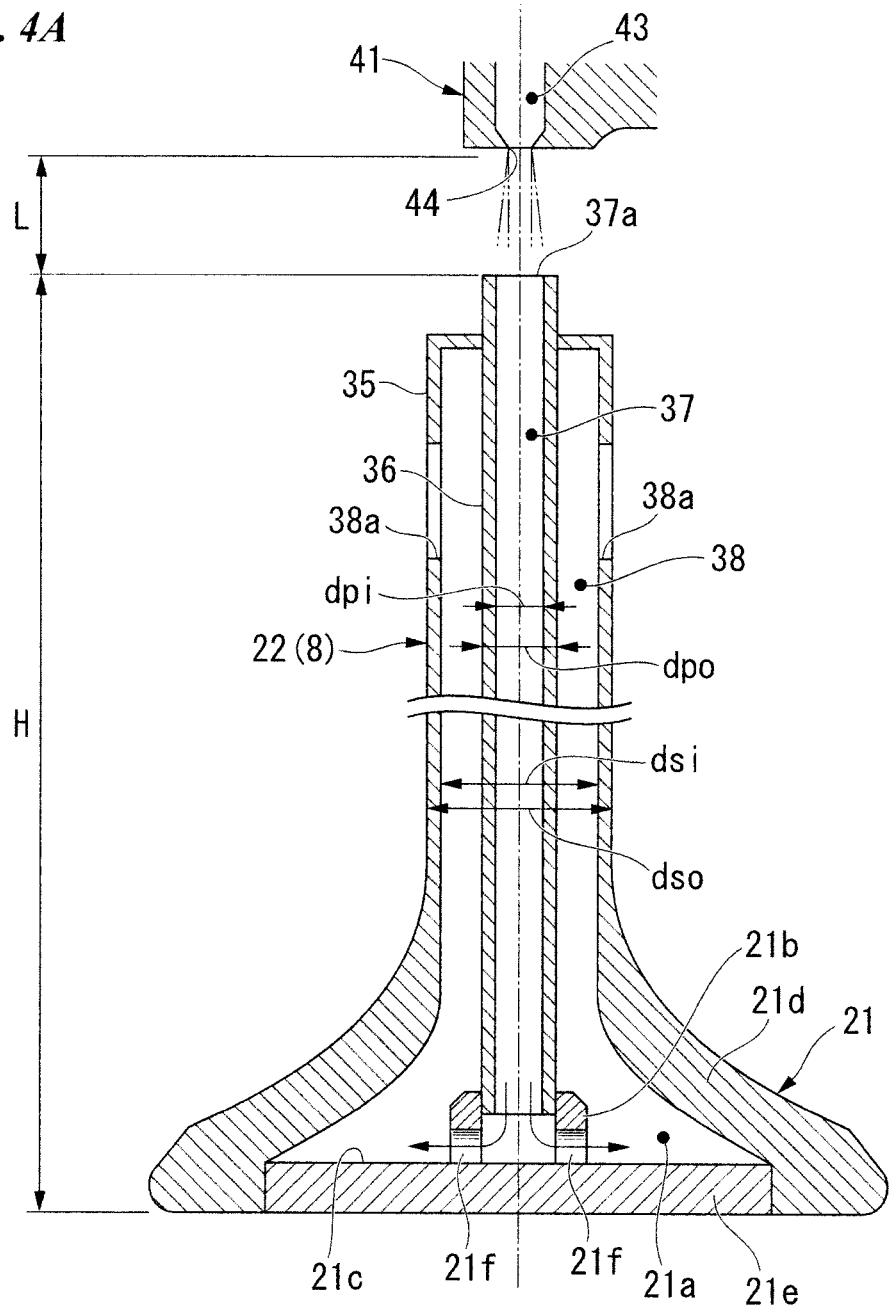
FIG. 4A is a cross-sectional view showing dimensions of the exhaust valve.

Also with reference to FIG. 4A for example, the hollow stem main body 35 is formed of a titanium alloy so as to be integrated with the upper portion 21*d* of the valve umbrella portion 21.

For example, the inner pipe 36 is made of a titanium alloy, the end portion of the valve operating chamber R2 side of the inner pipe is held so as to be inserted into the inner circumference of the end portion (thick portion) 35*a* of the valve operating chamber R2 side of the hollow stem main body 35, and the end portion of the combustion chamber R1 side of the inner pipe is held so as to be inserted into the inner circumference of a pipe holder 21*b* in the valve umbrella portion 21 (oil jacket 21*a*).

Figure 4B:
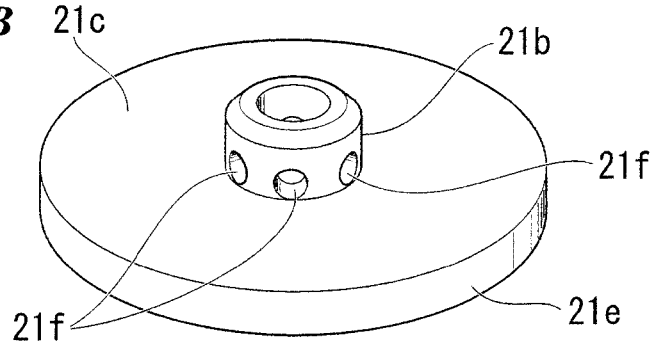
FIG. 4B is a perspective view of components of a valve bottom portion.

Also with reference to FIG. 4B, the pipe holder 21*b* is a swing stopper in which the end portion of the inner pipe 36 is inserted and held, is configured of a cylindrical shape having the same axis as the inner pipe 36, and for example, is formed of a titanium alloy so as to integrate with a disciform bottom portion 21*e* in the valve umbrella portion 21. A plurality of oil holes 21*f* are radially formed on the outer circumferential wall of the pipe holder 21*b*. The outer circumference of the bottom portion 21*e* is welded so as to be integrated with the inner circumference of the upper portion 21*d* of the valve umbrella portion 21 and is fixed.

As shown in FIG. 2, the end portion of the valve operating chamber R2 side of the inner pipe 36 extends so as to penetrate the valve lifter 25 and the tip portion 32 of the exhaust locker arm 7. The extended end portion of the inner pipe 36 penetrates the tip portion 32 of the exhaust locker arm 7 so as to have a predetermined allowance and allows the exhaust locker arm 7 to swing about the pivot 26. According to the swing of the exhaust locker arm 7, the exhaust valve 8 is pressed or is released from the pressing, and thereby, the exhaust valve 8 is operated so as to be opened and closed.

In the valve stem 22, the internal space of the inner pipe 36 becomes an oil introduction channel 37 and a cylindrical space between the inner pipe 36 and the hollow stem main body 35 becomes an oil lead-out channel 38.

The oil introduction channel 37 extends so as to be parallel to the valve stem 22, one end of the channel 37 is opened toward the extended direction (in valve operating chamber R2) at the tip (valve operating chamber R2 side end) of the inner pipe 36, and the other end of the channel is opened to the oil jacket 21*a* in the valve umbrella portion 21. Hereinafter, the opening at the tip of the inner pipe 36 of the oil introduction channel 37 is referred to as an oil introduction port 37*a*.

The oil jacket 21*a* is formed in a disk shape so as to be wider than the outer diameter of the valve stem 22 when viewed from the axial direction of the valve stem, and the oil jacket can cool the valve umbrella portion 21 over a wide area.

The oil lead-out channel 38 extends so as to be parallel to the valve stem 22, one end of the oil-lead out channel 38 is opened at the oil jacket 21*a* in the valve umbrella portion 21, and the other end of the oil lead-out channel 38 is opened further outward (in valve operating chamber R2) than the spring retainer 24 at the stem outer circumference of the combustion chamber R1 side. Hereinafter, the opening at the stem outer circumference of the oil lead-out channel 38 is referred to as an oil lead-out port 38*a*.

In addition, a jet portion 41, which can inject a part of the engine oil (hydraulic pressure) supplied to the cylinder head 19 through the cylinder side oil passage 18 toward the inner portion of the inner pipe 36 (inner portion of the oil introduction channel 37) of the valve stem 22, is provided at a portion that is positioned further toward the head tip side than the tip portion 32 of the exhaust locker arm 7 in the cylinder head 19.

As shown in FIG. 2, the jet portion 41 includes a guide oil passage 42 that obliquely extends toward an extended direction of the valve stem 22 from a gallery 39 for jet provided on the cylinder head 19, and a jet oil passage 43 that is bent at an acute angle from the tip of the guide oil passage 42 and coaxially extends toward the tip of the inner pipe 36 (oil lead-out port 38*a*) in the extended direction of the valve stem 22.

The gallery 39 for jet is provided so as to parallel to the exhaust cam shaft 6 and the intake cam shaft 2 between these (refer to FIG. 1), and is disposed so as to be closer to the intake locker arm 3 side rather than the tip portion 32 of the exhaust locker arm 7. The guide oil passage 42 of the jet portion 41 of each cylinder is separated and extends from the gallery 39 for jet.

At the opening of the tip of the jet oil passage 43, an orifice (oil jet) 44 is provided in which the flow channel of the opening is narrowed and the engine oil can be injected toward the oil introduction channel 37 (oil lead-out port 38*a*). The orifice 44 approaches the stem tip (oil introduction port 37*a*) of the exhaust valve 8 which is a full-closed state and injects the engine oil toward the oil introduction port 37*a* in a straight jet shape which has the same axis as the oil introduction port and is parallel to the port. The jet portion 41 can inject the engine oil to the oil introduction channel 37 of the exhaust valve 8 at an arbitrary stroke position between the full-closed state and a full-opened state of the exhaust valve 8.

Figure 7:
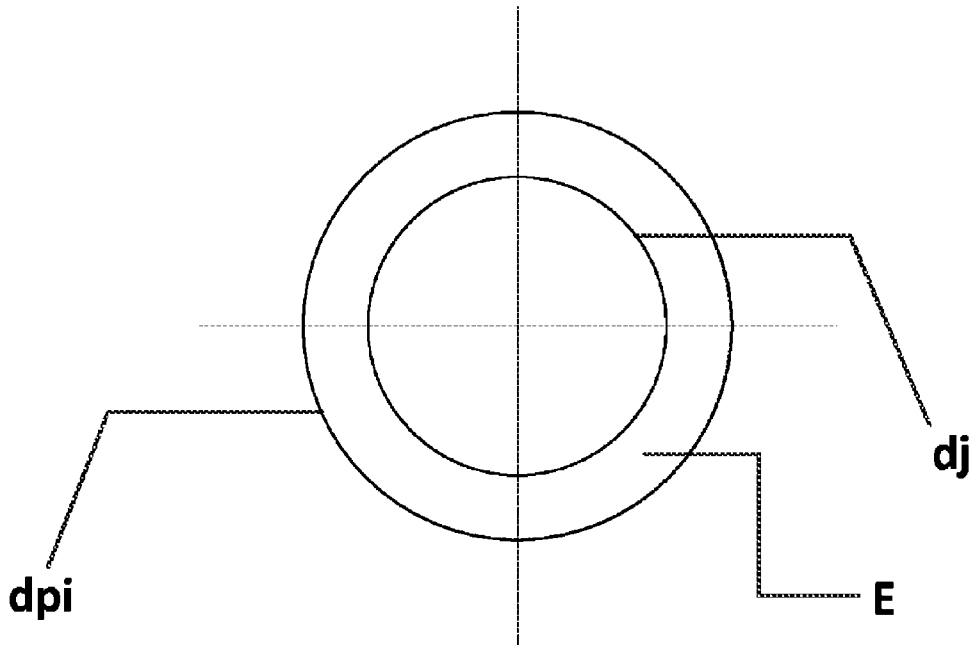
FIG. 7 is a diametrical view showing a diametrical tolerance zone between the jet injection to an oil introduction channel.

In the present embodiment, (refer to FIG. 7) concentricity E of the oil introduction channel 37 (oil introduction port 37*a*) with respect to the jet oil passage 43 (orifice 44) is determined considering processing errors, assembly errors, heat spread differences, and the like of engine components. However, the sum tolerance of the concentricity E and a diameter dj of the orifice 44 is set so as to be less than or equal to a diameter of the oil introduction port 37*a* (corresponding to an inner diameter dpi of the inner pipe 36).

That is, since a diffusion angle of the straight jet is minute and broadening of the injection is small even though the orifice 44 and the oil introduction port 37*a* are separated by a maximum lift amount of the exhaust valve 8, if a relationship of $dpi \geqq dj+E$ is satisfied, it is considered that the jet injection from the orifice 44 does not collide with the tip of the inner pipe 36 and enters the oil introduction port 37*a*.

Moreover, a flow channel area (cross-sectional area) Ao of the oil lead-out channel 38 in the valve stem 22 is set so as to satisfy a relationship of $Ao>Ai$ with respect to the flow channel area (cross-sectional area) of the oil introduction channel 37. Thereby, an oil discharging characteristic (easy discharge) from the oil lead-out channel 38 with respect to the jet injection to the oil introduction channel 37 is secured, and circulation of the engine oil in the exhaust valve 8 is improved. Moreover, since the present embodiment is not a structure in which the oil introduction port 37*a* and the oil lead-out port 38*a* are occluded, much more engine oil is supplied and cooling capacity can be enhanced.

EXAMPLE

With reference to FIG. 4A and Equation 1 and Equation 2 below, for example, if an inner pipe 36 having an outer diameter (dpo) of $\phi$ 2.8 mm and an inner diameter (dpi) of $\phi$ 1.8 mm is coaxially inserted into the hollow stem main body 35 having an outer diameter (dso) of $\phi$ 6 mm and an inner diameter (dsi) of $\phi$ 4 mm and the valve stem 22 is formed, in the flow channel area Ai of the oil introduction channel 37 and the flow channel area Ao of the oil lead-out channel 38, Ai=2.45 $mm^2$ and Ao=6.41 $mm^2$ are obtained based on Equation 1 and Equation 2 described below respectively.

$$Ao=(dsi^2-dpo^2)/4\times\pi \quad \text{[Equation 1]}$$

$$Ai=dpi^2/4\times\pi \quad \text{[Equation 2]}$$

In this way, the relationship of Ao>Ai is satisfied, and thereby, the discharging characteristic of the engine oil which is introduced into the valve stem 22 is secured.

In addition, if the diameter (dj) of the orifice 44 (jet injection port) is ϕ 1 mm, the shape of the jet is a parallel straight jet having a mainstream diffusion angle of approximately 0 degrees, and the concentricity (E) of the oil introduction port 37*a* (oil introduction channel 37) with respect to the orifice 44 (jet oil passage 43) is ϕ 0.8 mm, the mainstream of the oil jet satisfies the relationship of dpi≧dj+E, and thereby, the engine oil does not collide on the tip surface of the inner pipe 36 and enter the oil introduction port 37*a*.

Figure 5:
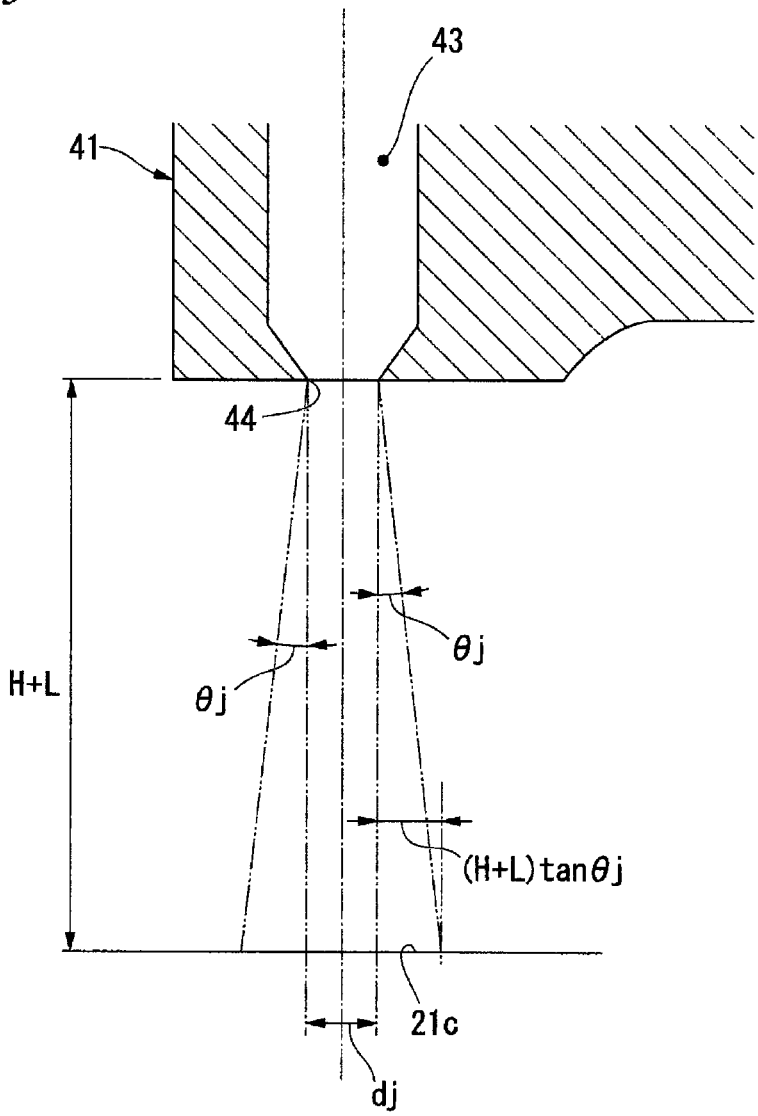
FIG. 5 is a cross-sectional view showing dimensions of jet injection to the exhaust valve.

Moreover, with reference to FIG. 5 and Equation 3 described below, when a distance H from the oil introduction port 37*a* to an inner bottom surface 21*c* of the valve umbrella portion (refer to FIG. 4A) which is a surface to be cooled is H and the valve maximum lift amount is L, if the mainstream diffusion angle θj of the oil jet is set to a value which is obtained from Equation 3 described below, a contact between the inner surface of the inner pipe 36 and the oil jet stream is suppressed, and the oil jet stream can be directly injected to the inner bottom surface 21*c* of the valve umbrella portion.

$$\theta j=\tan^{-1}((dpi-dj)/2(H+L)) \quad \text{[Equation 3]}$$

In this case, natural convection between oil spray in which the oil jet stream contacts the inner surface of the inner pipe 36 and the temperature is increased and the oil mainstream is suppressed, higher heat transfer is obtained due to impinging jet approximately perpendicular to the inner surface 21*c* in the valve umbrella portion through the coaxial injection into the inner pipe 36, heat exchange between the inner engine oil and the outer engine oil of the inner pipe 36 is also suppressed, and the exhaust valve 8 can be effectively cooled.

Moreover, since an arbitrary valve lift amount (l) which is less than the valve maximum lift amount and the concentricity (e) of the oil introduction channel 37 with respect to the jet oil passage 43 in the lift amount become L>l and E≧e respectively, Equations 1 to 3 are satisfied regardless of the valve lift state.

Figure 6:
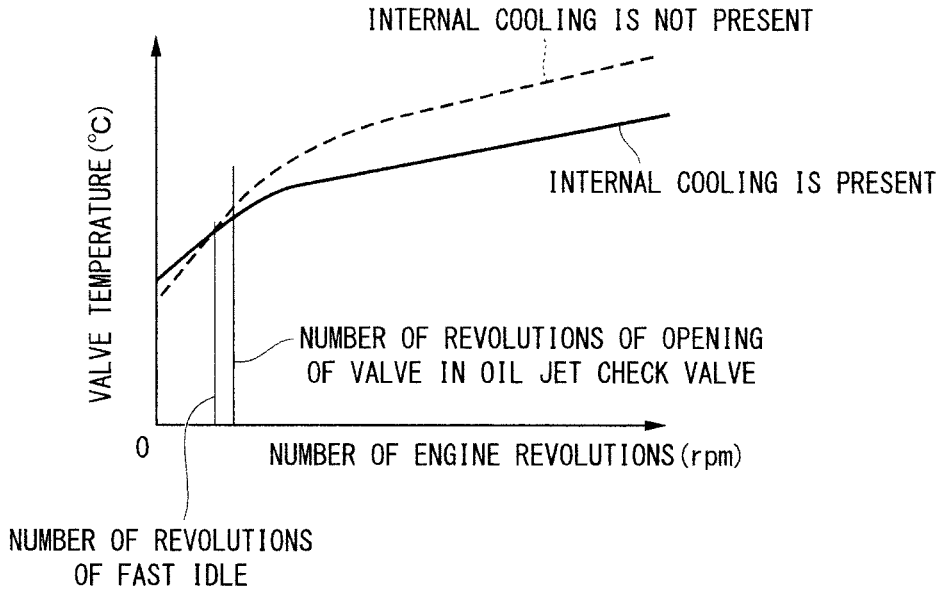
FIG. 6 is a graph showing a relationship between valve temperature and number of engine revolutions when a vertical axis is the valve temperature and a horizontal axis is the number of engine revolutions.

As shown in FIG. 6, a check valve is provided in the oil pressure pathway which reaches the jet portion 41, and the oil injection is set so as to be performed at the time of reaching a predetermined number of revolutions of the opening of the valve (for example, the number of revolutions in which a fast idle exceeds 300 rpm). Thereby, supercooling of the exhaust valve 8 at the time of cooling the engine 1 is prevented, knocking suppression effects or the like are obtained, and the temperature of the valve can be suppressed so as to be lower compared to a case where the internal cooling is not present when the engine 1 rotates at high speed.

As described above, in the valve cooling device of the internal combustion engine (engine 1) in the embodiment, the engine oil is circulated in the exhaust valve 8 which faces the combustion chamber R1.

The exhaust valve 8 includes the valve umbrella portion 21 that opens and closes the exhaust passage end from the combustion chamber R1 side, and the valve stem 22 that extends from the valve umbrella portion 21 to the valve operating chamber R2 side.

In the valve stem 22, the oil introduction channel 37 which extends so as to be parallel to the valve stem 22 and in which one end is opened in the extended direction of the valve stem and the other end reaches the inner portion of the valve umbrella portion 21, and the oil lead-out channel 38 which similarly extends so as to be parallel to the valve stem 22 and in which one end communicates with the other end of the oil introduction channel 37 in the valve umbrella portion 21 and the other end is opened to the inner portion of the valve operating chamber R2 are formed.

In the extended direction of the valve stem 22, a jet portion 41 having the jet oil passage 43 that is coaxially disposed with the oil introduction channel 37 is provided, and the engine oil is injected from the orifice 44 provided at the tip portion of the jet oil passage 43 into the oil introduction channel 37.

According to the above-described configuration, since the engine oil is coaxially injected from the orifice 44 of the jet portion 41 to the oil introduction channel 37 of the exhaust valve 8, the circulation of the engine oil in the exhaust valve 8 is favorably performed, the contact or collision of the engine oil with respect to the inner wall surface of the oil introduction channel 37 is suppressed, occurrence of heat exchange with the engine oil having a relatively high temperature in the oil lead-out channel 38 or the oil spray is suppressed, and valve coolability can be improved.

In addition, in the valve cooling device, the valve stem 22 includes the hollow stem main body 35 that forms the outer circumferential shape and an inner pipe 36 that is coaxially inserted into the hollow stem main body 35, the oil introduction channel 37 is formed on the inner circumference of the inner pipe 36, the cylindrical oil lead-out channel 38 is formed on the outer circumference of the inner pipe 36 and the inner circumference of the hollow stem main body 35, and the oil introduction channel 37 and the oil lead-out channel 38 can be effectively formed in the valve stem 22 having a double tube structure.

Moreover, in the valve cooling device, since the sum of the concentricity E between the inner pipe 36 and the orifice 44 and the diameter dj of the orifice 44 is smaller than the diameter dpi of the oil introduction port 37*a* of the oil introduction channel 37, the oil jet stream which is injected from the orifice 44 is introduced into the oil introduction channel 37 without the collision with the tip of the inner pipe 36, and the oil jet stream can be supplied to the valve cooling without waste.

In addition, in the valve cooling device, since the diffusion angle θj of the oil jet stream is set using the orifice diameter (jet diameter) dj and the stroke amount L of the valve, the contact of the oil jet stream to the inner wall surface of the inner pipe 36 is suppressed, the heat exchange of the engine oil before and after cooling the valve is suppressed, the oil jet stream can directly collide with the inner bottom surface 21*c* of the valve umbrella portion which is the surface to be cooled, and the valve coolability can be improved.

Moreover, in the valve cooling device, since the flow channel area Ao of the oil lead-out channel 38 is larger than the flow channel area Ai of the oil introduction channel 37, the discharging characteristic of the engine oil that is introduced into the exhaust valve 8 is secured, and the exhaust valve 8 can be effectively cooled.

In addition, in the valve cooling device, since the oil jacket 21*a* is formed so as to be wider than the outer diameter of the valve stem 22 when viewed from the axial direction of the valve stem 22 in the valve umbrella portion 21, the valve umbrella portion 21 which easily receives the heat of the combustion chamber R1 can be cooled over a wide area.

Moreover, since the valve cooling device includes the gallery 39 for jet that is provided between the exhaust cam shaft 6 and the intake cam shaft 2 and the jet portion 41 is connected to the gallery 39 for jet, the gallery 39 for jet is effectively disposed in the valve operating chamber R2 and the engine oil can be supplied to the jet portion 41.

In addition, the present invention is not limited to the embodiment. For example, the present invention is not limited to the line type engine having a plurality of cylinders, and may be also applied to a V type or a horizontal type engine having a plurality of cylinders or a single cylinder engine.

Moreover, the configuration in the embodiment is an example of the present invention, and various modifications may be performed within a scope without departing from the gist of the invention.

I claim:

1. A valve cooling device of an internal combustion engine in which engine oil is circulated in a valve that faces a combustion chamber, wherein the valve includes:

a valve umbrella portion that intakes air from a combustion chamber side or opens and closes an exhaust passage end; and a valve stem that extends from the valve umbrella portion to a valve operating chamber side, an inside of the valve stem is formed with an oil introduction channel which extends so as to be parallel to the valve stem and in which one end is opened in an extended direction of the valve stem and other end reaches an inner portion of the valve umbrella portion; and an oil lead-out channel which similarly extends so as to be parallel to the valve stem and in which one end communicates with the other end of the oil introduction channel in the valve umbrella portion and other end is opened to an inner portion of the valve operating chamber, a jet portion that includes a jet oil passage coaxially disposed with the oil introduction channel is provided in the extended direction of the valve stem, and the engine oil is injected from an orifice provided on a tip portion of the jet oil passage to an inner portion of the oil introduction channel, the tip portion of the jet oil passage being apart from the oil introduction channel.

2. The valve cooling device of an internal combustion engine according to claim 1, wherein the valve stem includes a hollow stem main body that forms an outer circumferential shape and an inner pipe that is coaxially inserted into the hollow stem main body, and the oil introduction channel is formed on an inner circumference of the inner pipe, and the cylindrical oil lead-out channel is formed on an outer circumference of the inner pipe and an outer circumference of the hollow stem main body.

3. The valve cooling device of an internal combustion engine according to claim 2, wherein a sum of concentricity between the inner pipe and the orifice and a diameter of the orifice is smaller than a diameter of an oil introduction port of the oil introduction channel.

4. The valve cooling device of an internal combustion engine according to claim 3, wherein a diffusion angle θj of an oil jet stream that is injected from the orifice is expressed by Equation A below when an inner diameter of the inner pipe is dpi, a diameter of the orifice is dj, a distance from the orifice to an inner bottom surface of the valve umbrella portion is H, and a valve maximum lift amount is L, $$\theta j = \tan^{-1}\{(dpi - dj)/2(H+L)\}. \quad \text{Equation A}$$

5. The valve cooling device of an internal combustion engine according to claim 2, wherein a diffusion angle θj of an oil jet stream that is injected from the orifice is expressed by Equation A below when an inner diameter of the inner pipe is dpi, a diameter of the orifice is dj, a distance from the orifice to an inner bottom surface of the valve umbrella portion is H, and a valve maximum lift amount is L, $$\theta j = \tan^{-1}\{(dpi - dj)/2(H+L)\}. \quad \text{Equation A}$$

6. The valve cooling device of an internal combustion engine according to any one of claims 1 to 5, wherein a flow channel area of the oil lead-out channel is larger than a flow channel area of the oil introduction channel.

7. The valve cooling device of an internal combustion engine according to any one of claims 1 to 5, wherein an oil jacket that has an outer diameter larger than an outer diameter of the stem when viewed from an axial direction of the valve stem is formed in the valve umbrella portion.

8. The valve cooling device of an internal combustion engine according to any one of claims 1 to 5, wherein a gallery for jet is provided between an exhaust cam shaft and an intake cam shaft, and the jet portion is connected to the gallery for jet.

9. The valve cooling device of an internal combustion engine according to any one of claims 1 to 5, wherein a diameter of the jet oil passage is smaller than a diameter of the oil introduction channel.

10. A valve cooling device of an internal combustion engine in which engine oil is circulated in a valve that faces a combustion chamber, wherein the valve includes:

a valve umbrella portion that intakes air from a combustion chamber side or opens and closes an exhaust passage end; and a valve stem that extends from the valve umbrella portion to a valve operating chamber side, an inside of the valve stem is formed with an oil introduction channel which extends so as to be parallel to the valve stem and in which one end is opened in an extended direction of the valve stem and other end reaches an inner portion of the valve umbrella portion; and an oil lead-out channel which similarly extends so as to be parallel to the valve stem and in which one end communicates with the other end of the oil introduction channel in the valve umbrella portion and other end is opened to an inner portion of the valve operating chamber, a jet portion that includes a jet oil passage coaxially disposed with the oil introduction channel is provided in the extended direction of the valve stem, and the engine oil is injected from an orifice provided on a tip portion of the jet oil passage to an inner portion of the oil introduction channel, wherein the valve stem includes a hollow stem main body that forms an outer circumferential shape and an inner pipe that is coaxially inserted into the hollow stem main body, and the oil introduction channel is formed on an inner circumference of the inner pipe, and the cylindrical oil lead-out channel is formed on an outer circumference of the inner pipe and an outer circumference of the hollow stem main body; and wherein a sum of concentricity between the inner pipe and the orifice and a diameter of the orifice is smaller than a diameter of an oil introduction port of the oil introduction channel.

11. The valve cooling device of an internal combustion engine according to claim 10, wherein a diffusion angle θj of an oil jet stream that is injected from the orifice is expressed by Equation A below when an inner diameter of the inner pipe is dpi, a diameter of the orifice is dj, a distance from the orifice to an inner bottom surface of the valve umbrella portion is H, and a valve maximum lift amount is L, $$\theta j=\tan^{-1}\{(dpi-dj)/2(H+L)\}. \quad \text{Equation A}$$

12. A valve cooling device of an internal combustion engine in which engine oil is circulated in a valve that faces a combustion chamber, wherein the valve includes:

a valve umbrella portion that intakes air from a combustion chamber side or opens and closes an exhaust passage end; and a valve stem that extends from the valve umbrella portion to a valve operating chamber side, an inside of the valve stem is formed with an oil introduction channel which extends so as to be parallel to the valve stem and in which one end is opened in an extended direction of the valve stem and other end reaches an inner portion of the valve umbrella portion; and an oil lead-out channel which similarly extends so as to be parallel to the valve stem and in which one end communicates with the other end of the oil introduction channel in the valve umbrella portion and other end is opened to an inner portion of the valve operating chamber, a jet portion that includes a jet oil passage coaxially disposed with the oil introduction channel is provided in the extended direction of the valve stem, and the engine oil is injected from an orifice provided on a tip portion of the jet oil passage to an inner portion of the oil introduction channel, wherein the valve stem includes a hollow stem main body that forms an outer circumferential shape and an inner pipe that is coaxially inserted into the hollow stem main body, and the oil introduction channel is formed on an inner circumference of the inner pipe, and the cylindrical oil lead-out channel is formed on an outer circumference of the inner pipe and an outer circumference of the hollow stem main body, wherein a diffusion angle θj of an oil jet stream that is injected from the orifice is expressed by Equation A below when an inner diameter of the inner pipe is dpi, a diameter of the orifice is dj, a distance from the orifice to an inner bottom surface of the valve umbrella portion is H, and a valve maximum lift amount is L, $$\theta j=\tan^{-1}\{(dpi-dj)/2(H+L)\}. \quad \text{Equation A}$$

* * * * *